US008786380B2

(12) United States Patent
Mahon et al.

(10) Patent No.: US 8,786,380 B2
(45) Date of Patent: Jul. 22, 2014

(54) CIRCULAR POLARIZER USING STEPPED CONDUCTIVE AND DIELECTRIC FINS IN AN ANNULAR WAVEGUIDE

(75) Inventors: John P. Mahon, Thousand Oaks, CA (US); Cynthia P. Espino, Carlsbad, CA (US)

(73) Assignee: Optim Microwave, Inc., Camarillo, CA (US)

( * ) Notice: Subject to any disclaimer, the term of this patent is extended or adjusted under 35 U.S.C. 154(b) by 366 days.

(21) Appl. No.: 13/220,964

(22) Filed: Aug. 30, 2011

(65) Prior Publication Data

US 2012/0319804 A1 Dec. 20, 2012

Related U.S. Application Data

(63) Continuation-in-part of application No. 12/685,134, filed on Jan. 11, 2010, now Pat. No. 8,008,984, which is a continuation of application No. 12/058,560, filed on Mar. 28, 2008, now Pat. No. 7,656,246.

(51) Int. Cl.
*H01P 1/17* (2006.01)
*H01P 1/165* (2006.01)

(52) U.S. Cl.
CPC . *H01P 1/17* (2013.01); *H01P 1/165* (2013.01)
USPC ..... 333/21 A; 333/157; 333/160

(58) Field of Classification Search
CPC ..... H01P 1/165; H01P 1/17; H01P 1/171; H01P 1/172; H01P 1/173
USPC ..... 333/21 A, 157, 160, 248
See application file for complete search history.

(56) References Cited

U.S. PATENT DOCUMENTS

| | | | | |
|---|---|---|---|---|
| 4,523,160 | A | 6/1985 | Ploussios | |
| 4,725,795 | A | 2/1988 | Ajioka et al. | |
| 4,982,171 | A | 1/1991 | Figlia et al. | |
| 6,417,742 | B1 | 7/2002 | Enokuma | |
| 7,656,246 | B2 | 2/2010 | Mahon et al. | |
| 8,008,984 | B2 * | 8/2011 | Mahon et al. | 333/21 A |

* cited by examiner

*Primary Examiner* — Benny Lee
(74) *Attorney, Agent, or Firm* — SoCal IP Law Group LLP; John E. Gunther; Steven C. Sereboff

(57) ABSTRACT

A polarization converter may include an annular waveguide comprising an inner conductor having an outer surface and an outer conductor having an inner surface coaxial with the outer surface of the inner conductor. A plurality of loading structures may be disposed within the annular waveguide to form a plurality of regions within the annular waveguide including an alternating sequence of high phase shift regions and low phase shift regions along a direction of propagation of an electromagnetic wave. The plurality of loading structures may be configured to introduce a predetermined relative phase shift between orthogonally polarized first and second components of the electromagnetic wave for a predetermined operating frequency band. The plurality of loading structures may be further configured to suppress propagation of one or more higher order modes in the annular waveguide over the operating frequency band.

15 Claims, 10 Drawing Sheets

© 2010 Optim Microwave

© 2010 Optim Microwave

Section A-A 100
120
122
140

Section C-C
d2
d3
d4
d1
144
100
136
45°
120
122
140
142

Section B-B
120
132b
134
120
132a
134
© 2010 Optim Microwave

Section C'-C'

Section B'-B'

© 2010 Optim Microwave

© 2010 Optim Microwave

© 2010 Optim Microwave

© 2010 Optim Microwave

© 2010 Optim Microwave

© 2010 Optim Microwave

© 2010 Optim Microwave

CIRCULAR POLARIZER USING STEPPED CONDUCTIVE AND DIELECTRIC FINS IN AN ANNULAR WAVEGUIDE

RELATED APPLICATION INFORMATION

This application is a continuation-in-part of application Ser. No. 12/685,134, filed Jan. 11, 2010, titled CIRCULAR POLARIZER USING INTERLOCKED CONDUCTIVE AND DIELECTRIC FINS IN A COAXIAL WAVEGUIDE, now U.S. Pat. No. 8,008,984, which is a continuation of application Ser. No. 12/058,560, filed Mar. 28, 2008, titled CIRCULAR POLARIZER USING CONDUCTIVE AND DIELECTRIC FINS IN A COAXIAL WAVEGUIDE, now U.S. Pat. No. 7,656,246.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to linear polarization to circular polarization converters for use in coaxial waveguides.

2. Description of the Related Art

Satellite broadcasting and communications systems commonly use separate frequency bands for the uplink to and downlink from satellites. Additionally, one or both of the uplink and downlink typically transmit orthogonal right-hand and left-hand circularly polarized signals within the respective frequency band.

Typical antennas for transmitting and receiving signals from satellites consist of a parabolic dish reflector and a coaxial feed where the high frequency band signals travel through a central circular waveguide and the low frequency band signals travel through an annular waveguide coaxial with the high-band waveguide. An ortho-mode transducer (OMT) may be used to launch or extract orthogonal $TE_{11}$ linear polarized modes into the high- and low-band coaxial waveguides. TE (transverse electric) modes have an electric field orthogonal to the longitudinal axis of the waveguide. Two orthogonal $TE_{11}$ modes do not interact or cross-couple, and can therefore be used to communicate different information. A linear polarization to circular polarization converter is commonly disposed within each of the high- and low-band coaxial waveguides to convert the orthogonal $TE_{11}$ modes into left- and right-hand circular polarized modes for communication with the satellite.

Converting linearly polarized $TE_{11}$ modes into circularly polarized modes requires splitting each $TE_{11}$ mode into two orthogonally polarized portions and then shifting the phase of one portion by 90 degrees with respect to the other portion. This may conventionally be done by inserting two or more dielectric vanes, oriented at 45 degrees to the polarization planes of the $TE_{11}$ modes, into the waveguide as described in U.S. Pat. No. 6,417,742 B1. However, assembling the dielectric vanes at the precise angle within the waveguide can be problematic. Errors in assembling the dielectric vanes can result in imperfect polarization conversion and cross-talk between the two orthogonally polarized $TE_{11}$ modes.

Throughout this description, elements appearing in figures are assigned three-digit reference designators, where the most significant digit is the figure number where the element was first introduced and the two least significant digits are specific to the element. An element that is not described in conjunction with a figure may be presumed to have the same characteristics and function as a previously-described element having the same reference designator.

DETAILED DESCRIPTION

Description of Apparatus

Figures 1A, 1B:
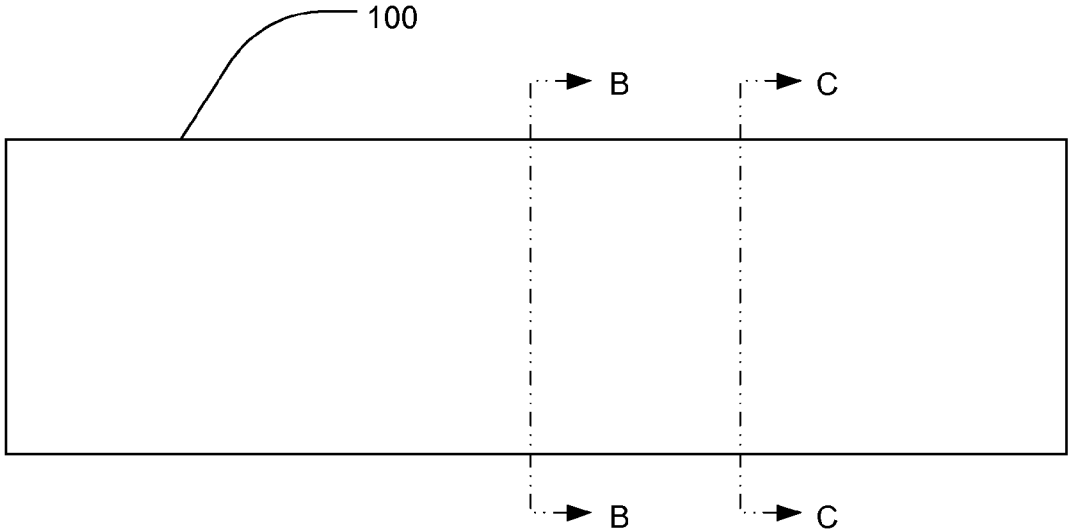
FIG. 1A is an end view of a coaxial waveguide including a linear polarization to circular polarization converter.
FIG. 1B is a side view of a coaxial waveguide including a linear polarization to circular polarization converter.

FIG. 1A is an end view of a linear polarization to circular polarization converter 100, and FIG. 1B is a side view of the linear polarization to circular polarization converter 100. As shown in FIG. 1A, the linear polarization to circular polarization converter 100 may include an outer conductor 110 and an inner conductor 120. The inner conductor 120 may have an outer surface 122 that has a generally circular cross section except for two diametrically opposed fins 130 extending outward from the outer surface 122. The outer conductor 110 may have an inner surface 114 that is generally coaxial with the outer surface 122 of the inner conductor 120. In this description, the terms generally circular and generally coaxial mean circular and coaxial within the limits of reasonable manufacturing tolerances. The space between the inner surface 114 of the outer conductor 110 and the outer surface 122 of the inner conductor 120 may define an annular waveguide 140.

The inner conductor 120 may be generally in the form of a tube having an inner surface 124 with a generally circular cross section. The inner surface 124 may define a circular waveguide 150.

The outer conductor 110 may have an outer surface 112 that may be generally circular in cross section, as shown in FIG. 1A, or may be another shape. For example, the outer surface 112 may have a square cross section for ease of manufacturing and/or mounting.

Figure 2:
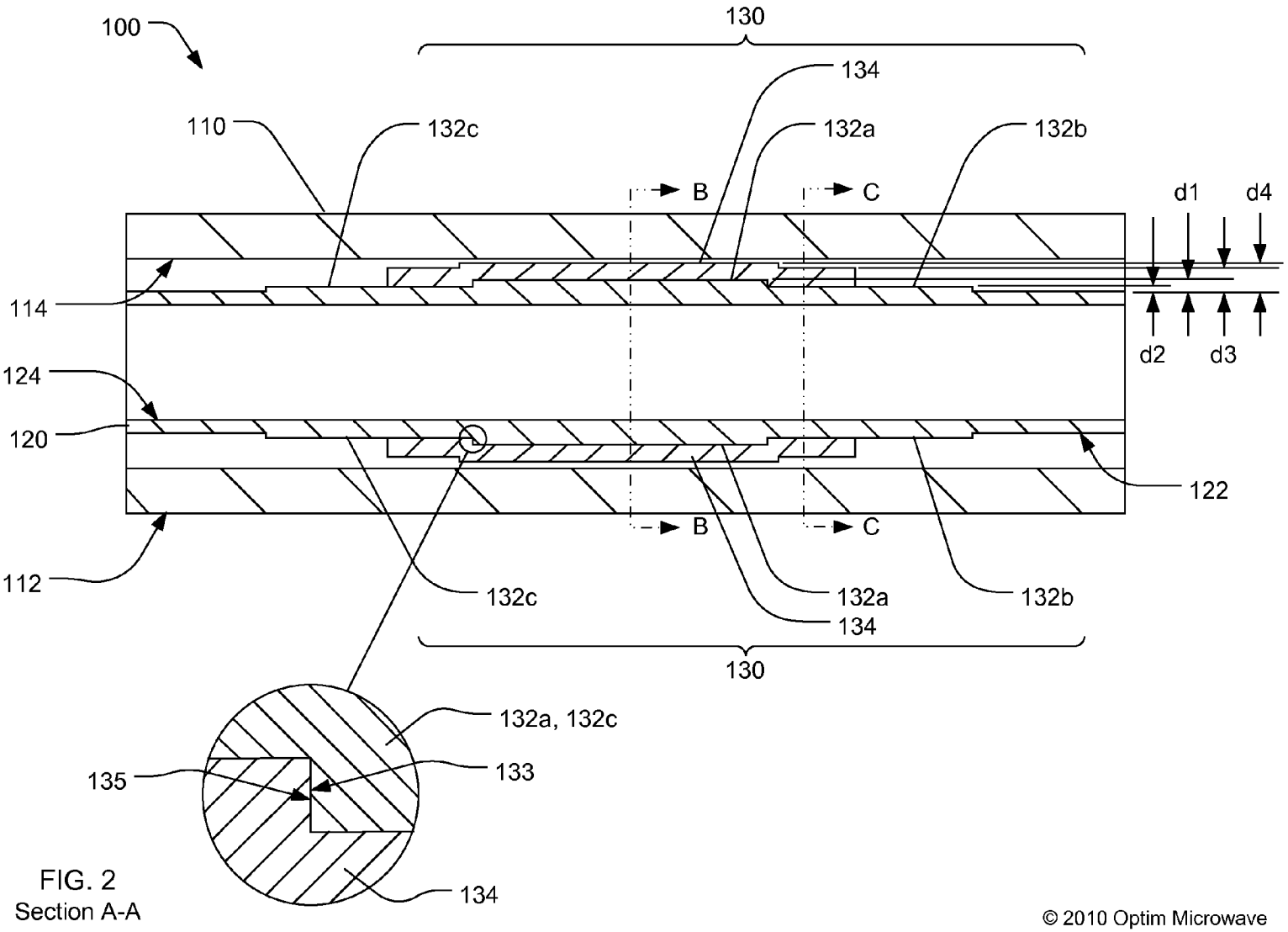
FIG. 2 is a longitudinal cross section of the coaxial waveguide of FIG. 1A.

FIG. 2 shows a cross section of the linear polarization to circular polarization converter 100 along a plane A-A as identified in FIG. 1A. The linear polarization to circular polarization converter 100 may include an outer conductor 110 having an outer surface 112 and an inner surface 114. The linear polarization to circular polarization converter 100 may also include an inner conductor 120 having an outer surface 122 and an inner surface 124. Two diametrically opposed fins 130 may extend from the outer surface 122 of the inner conductor 120.

The diametrically opposed fins 130 may include a conductive fin 132*a*/132*b*/132*c* and a dielectric fin 134. Each conductive fin 132*a*/132*b*/132*c* may be stepped in a longitudinal direction. Each conductive fin may include a central portion 132*a* flanked by symmetrical side portions 132*b* and 132*c*. The central portion 132*a* may extend a first distance d1 from the outer surface 122. The side portions 132*b* and 132*c* may extend a second distance d2 from the outer surface 122, where the second distance d2 is less than the first distance d1. Each dielectric fin 134 may extend at least a third distance d3 from the outer surface 122, where d3 is greater than d1. The distance that each dielectric fin 134 extends from the outer surface 122 may be stepped. Each dielectric fin may include a central portion that extends a fourth distance d4 from the outer surface 122, where d4 is greater than d3.

As shown in the detail at the lower left of FIG. 2, the conductive fin may include a step 133 between the side portion 132*c* and the central portion 132*a*. A similar step may exist between the central portion 132*a* and the side portion 132*b*. The dielectric fin may include a complementary step 135. The interface between the step 135 in the dielectric fin 134 and the step 133 in the conductive fin may act to position and constrain the dielectric fin 134 in the longitudinal direction.

Figures 3A, 3B:
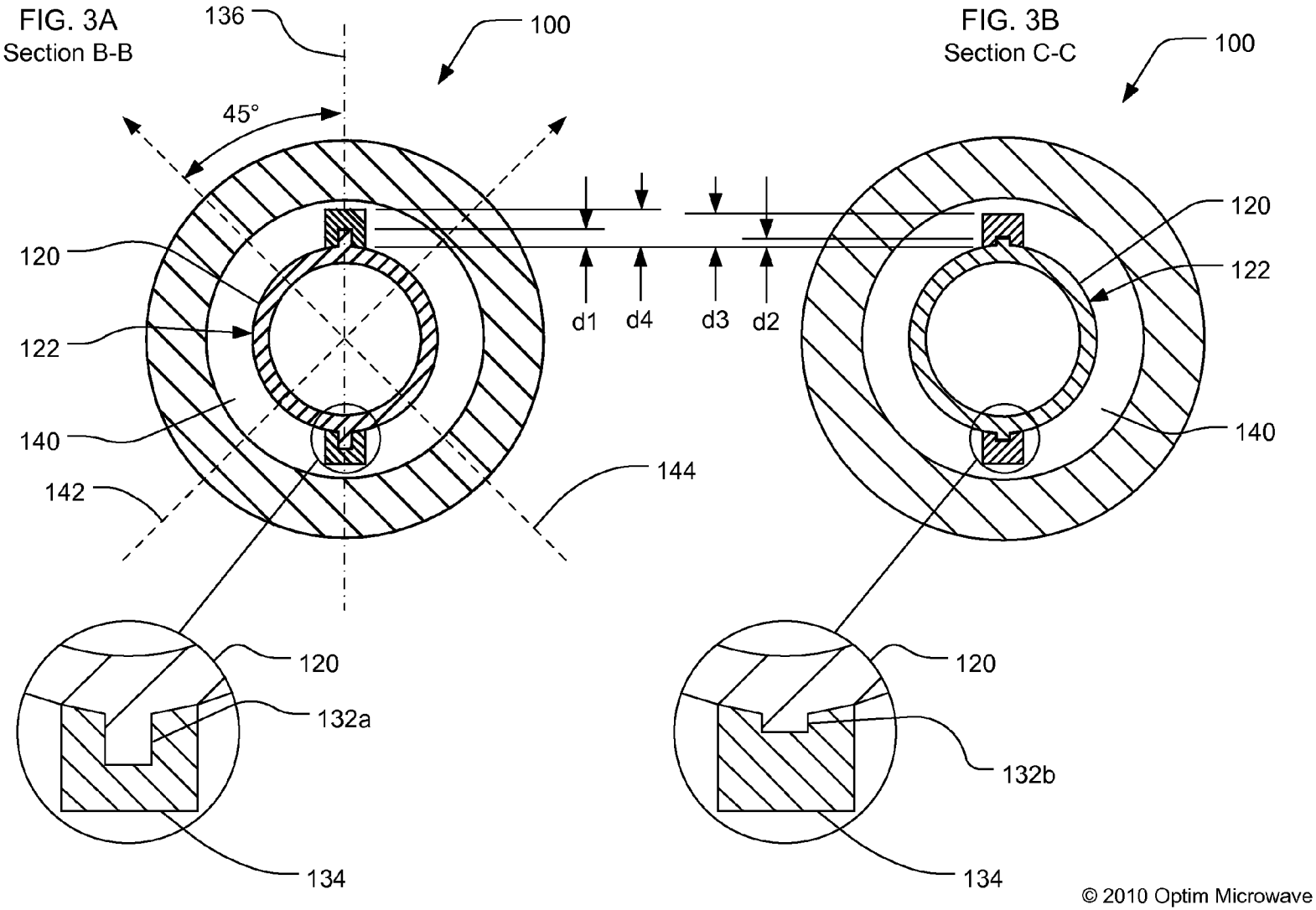
FIG. 3A is a first axial cross section of the coaxial waveguide of FIG. 1B.
FIG. 3B is a second axial cross section of the coaxial waveguide of FIG. 1B.

FIG. 3A and FIG. 3B show cross sections of the linear polarization to circular polarization converter 100 along plane B-B and plane C-C, respectively, as identified in FIG. 1B and FIG. 2. Each dielectric fin 134 may be formed with a longitudinal (perpendicular to the plane of the drawings) notch that may engage the respective conductive fin portions 132*a* and 132*b* as shown in FIGS. 3A and 3B, respectively. The notch in each dielectric fin 134 may be conformal or nearly conformal to the conductive fin portions 132*a* and 132*b* such that the conductive fin portions 132*a* and 132*b* align and constrain the respective dielectric fin 134 in the transverse direction.

The conductive fin portions 132*a*, 132*b*, 132*c* (FIG. 2) may align and constrain the position of the respective dielectric fin 134 both longitudinally and transversely such that each dielectric fin 134 is interlocked with the corresponding conductive fin portions 132*a*, 132*b*, 132*c*. In this description, "interlocked" has the normal meaning of "connected in such a way that the motion of any part is constrained by another part". Within the linear polarization to circular polarization converter 100, the position of each dielectric fin 134 may be aligned and constrained by the corresponding conductive fin portions 132*a*, 132*b*, 132*c*.

The inner conductor 120 may be fabricated from aluminum or copper or another highly conductive metal or metal alloy. The conductive fin portions 132*a*, 132*b*, 132*c* may be integral to the inner conductor. The conductive fin portions 132*a*, 132*b*, 132*c* may be fabricated by numerically controlled machining and thus may be precisely located on the outer surface 122 of the inner conductor 120. The dielectric fins 134 may be fabricated from a low-loss polystyrene plastic material such as REXOLITE® (available from C-LEC Plastics) or another dielectric material suitable for use at the frequency of operation of the linear polarization to circular polarization converter 100.

Referring to FIG. 3A, the conductive fin portions 132*a*, 132*b* (FIG. 3B) and the dielectric fins 134 may be symmetrical about a symmetry plane 136 passing through the axis of the inner conductor 120. In use, the symmetry plane 136 may be oriented at a 45 degree angle to the polarization planes 142 and 144 of two linearly polarized TE modes traveling in the annular waveguide 140.

Figure 4B:
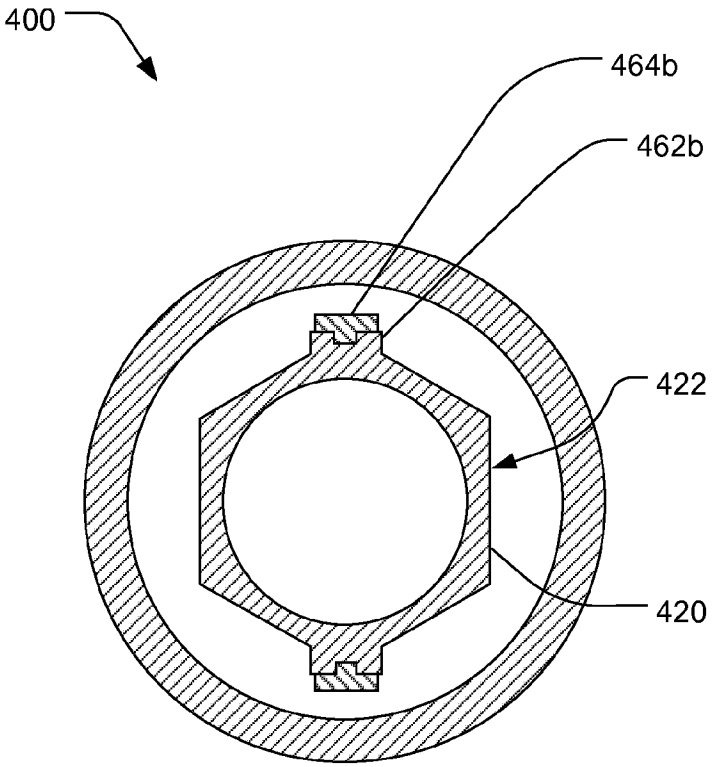
FIG. 4B is a second axial cross section of the linear polarization to circular polarization converter of FIG. 4A.
Figure 4A:
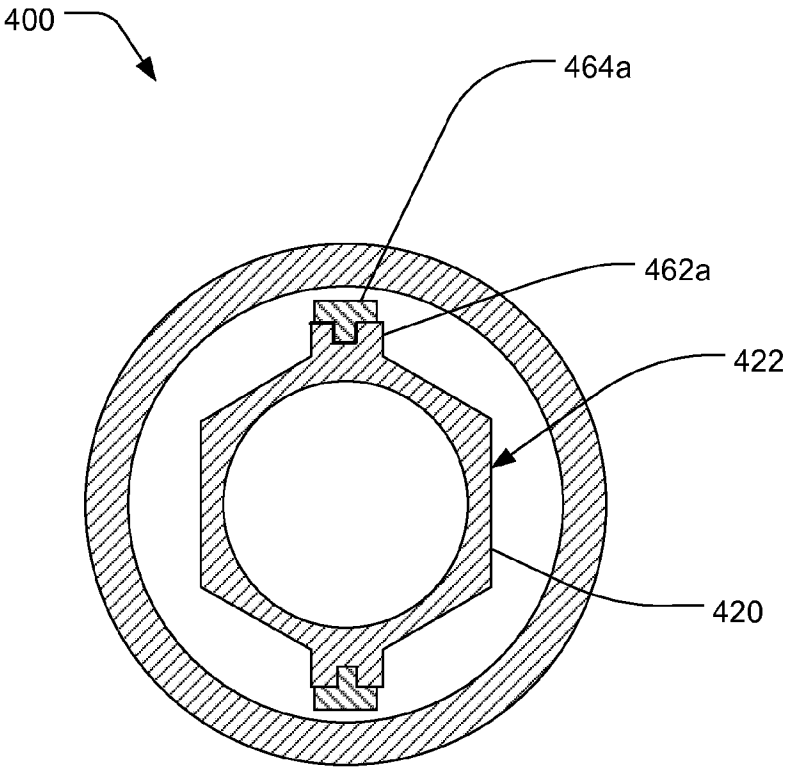
FIG. 4A is a first axial cross section of another linear polarization to circular polarization converter.

FIG. 4A and FIG. 4B show cross sections of another linear polarization to circular polarization converter 400 along plane B'-B' and plane C'-C', respectively, which may be the same as planes B-B and C-C identified in FIG. 1B and FIG. 2.

The linear polarization to circular polarization converter 400 may include an inner conductor 420 having an outer surface 422. A pair of diametrically opposed conductive fins 462*a*/462*b*, shown in FIG. 4A and FIG. 4B respectively, may extend outward from the outer surface 422. A pair of dielectric fins 464*a*/464*b*, shown in FIG. 4A and FIG. 4B respectively, may be interlocked with the respective conductive fins. The dielectric fins 464*a*/464*b* may have a "T"-shaped cross-section. The legs of the "T"-shaped dielectric fins 464*a*/464*b* may fit within mating longitudinal slots in the corresponding conductive fins 462*a*/462*b*. The conductive fins 462*a*/462*b* may align and constrain dielectric fins 464*a*/464*b* as previously described.

The linear polarization to circular polarization converter 400 may include an inner conductor 420 having an outer surface 422. The outer surface 422 may have a cross-sectional shape of a hexagon, as shown, an octagon, or another regular polygon with an even number of sides. An outer surface having a circular cross section, such as the outer surface 112 in FIG. 1, may be fabricated by turning on a lathe. However, the presence of conductive fins 132*a*/132*b*/132*c* or 462*a*/462*b* precludes the use of a lathe, and the outer surface 122, 422 of the respective inner conductor 120, 420 may be fabricated by numerically controlled milling. The polygonal cross-section of the outer surface 422 may be less costly to machine than the circular cross-section of the outer surface 122.

The "T"-shaped dielectric fins 464*a*/464*b* and corresponding conductive fins 462*a*/462*b* of FIG. 4A and FIG. 4B, respectively, and the dielectric fins 134 (FIG. 2) and corresponding conductive fins 132*a*/132*b* of FIG. 3A and FIG. 3B, respectively, are examples of dielectric fins that are mechanically interlocked with conductive fins. The dielectric fins and the conductive fins may incorporate other combinations of tabs, slots, pins, holes, or any other mechanisms that allow the conductive fins to support and align the dielectric.

Other combinations of dielectric and conductive fins may be used with an inner conductor having an outer surface with either a circular cross-section or polygonal cross-section. For example, the "T"-shaped dielectric fins 464*a*/464*b* and corresponding conductive fins 462*a*/462*b* of FIG. 4A and FIG. 4B, respectively, may be used with an inner conductor having an outer surface with a circular cross section. Conversely, the dielectric fins 134 and corresponding conductive fins 132*a*/132*b* of FIG. 3A and FIG. 3B, respectively, may be combined with an inner conductor having an outer surface with a polygonal cross-section.

Structures, such as the previously-described dielectric and conductive fins, within an annular waveguide may cause undesired resonances within the operating bandwidth of a polarization converter within a feed network or other waveguide system. For example, resonances may occur due to excitation of higher order modes that then resonate within the annular waveguide. In this patent, the term "higher order" has the conventional meaning of any mode having an order higher than the desired propagating modes of the waveguide. For this application, the desired propagating modes in the annular waveguide are orthogonal $TE_{11}$ or $HE_{11}$ (if dielectric is present within the waveguide) modes. A resonating higher order mode may result in objectionable variations in the performance of the polarization converter as a function of frequency. To prevent the resonance of higher order modes, the conductive and/or dielectric fins may be configured to suppress propagation of one or more higher order modes in the annular waveguide.

Figure 5:
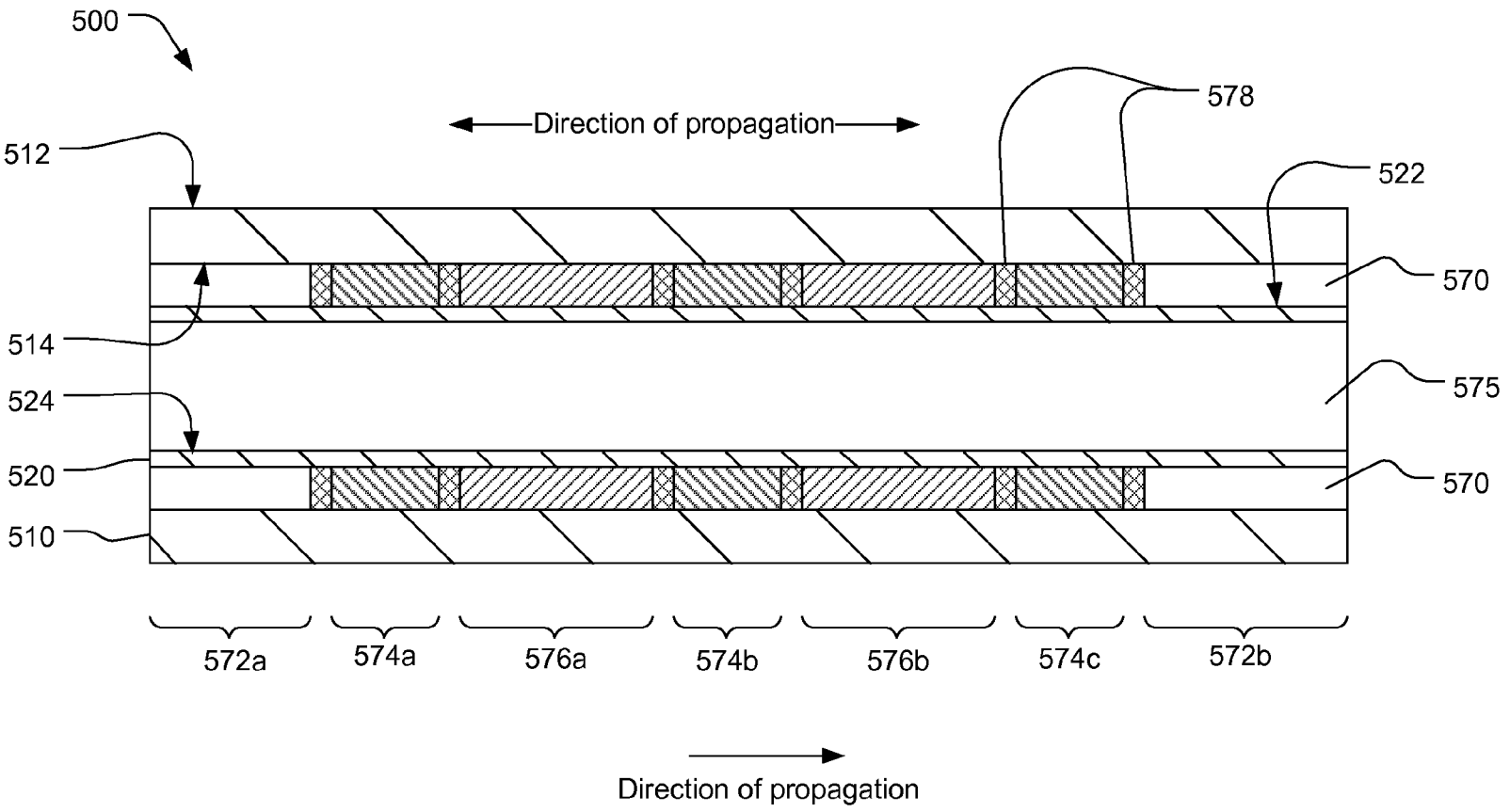
FIG. 5 is a longitudinal cross section of a coaxial waveguide.

FIG. 5 shows a cross section of waveguide device 500. The waveguide device 500 may include an outer conductor 510 having an outer surface 512 and an inner surface 514. The waveguide device 500 may also include an inner conductor 520 having an outer surface 522. An annular waveguide 570 may be defined by the outer surface 522 of the inner conductor 520 and the inner surface 514 of the outer conductor. The inner conductor 520 may be solid, or may have an inner surface 524 that defines a circular cylindrical waveguide 575 concentric with the annular waveguide 570.

The annular waveguide 570 may be divided into a plurality of regions along a direction of propagation. The plurality of regions may include normal waveguide regions 572*a*, 572*b* and an alternating sequence of high phase shift regions 574*a*, 574*b*, 574*c* and low phase shift regions 576*a*, 576*b*. In this context, a "phase shift region" is a portion of the annular waveguide in which the phase of a first mode is shifted with respect to the phase of a second mode orthogonal to the first mode. The terms "high" and "low" are relative. A "high phase shift region" provides more phase shift per unit propagation length than is provided by a "low phase shift region". A low phase shift region may provide little or no phase shift. The high phase shift and low phase shift regions may be configured such that the cumulative phase shift introduced to the first mode after propagating the length of the annular waveguide 570 is 90 degrees, 180 degrees, or some other predetermined phase shift.

In the example of FIG. 5, the annular waveguide 570 includes three high phase shift regions 574*a*, 574*b*, 574*c* and two low phase shift regions 576*a*, 576*b*. An annular waveguide may have two or more high phase shift regions separated by low phase shift regions such that the number of low phase shift regions is one less than or one more than the number of high phase shift regions. The high phase shift regions are not necessarily identical in structure or length. When two or more low phase shift regions are present, the low phase shift regions are also not necessarily identical in structure or length.

The normal waveguide regions 572*a*, 572*b* may be configured to allow propagation of two orthogonal $TE_{11}$ modes within a predetermined operating frequency band. In order to provide sufficient phase shift within a reasonable length device, it may be necessary to allow the high phase shift regions 574*a*, 574*b*, 574*c* to support propagation of one or more higher order modes within the operating frequency band. The supported higher order modes may include, for example, a $TE_{21}$ mode and/or some other higher order mode. The low phase shift regions 576*a*, 576*b* may be configured to suppress propagation of the higher order modes supported by the high phase shift regions. The low phase shift regions 576*a*, 576*b* may be configured to allow propagation of only two orthogonal $TE_{11}$ or $HE_{11}$ modes within the operating frequency band. The high phase shift regions and the low phase shift regions may be collectively configured to prevent resonance of any higher order mode within the annular waveguide 570 over the operating frequency band.

The alternating sequence of high phase shift regions 574*a*, 574*b*, 574*c* and low phase shift regions 576*a*, 576*b* may be created by loading structures (not shown) within the annular waveguide 570. In this patent, a "loading structure" is any structure or material that changes the shape and/or impedance of the annular waveguide. The loading structures may be or include, for example, metal and/or dielectric fins extending from the outer surface 522 of the inner conductor 520, metal and/or dielectric fins extending from the inner surface 514 of the outer conductor 510, dielectric cards or blocks disposed within the annular waveguide 570, or any other structure adapted to shift the phase of the first mode with respect to the phase of the second mode.

The loading structures may be further configured to form transitions 578 between adjacent normal waveguide regions and high phase shift regions. Transitions 578 may also be formed between adjacent high phase shift and low phase shift regions. Transitions may provide, for example, impedance matching between adjacent regions of the annular waveguide. While FIG. 5 shows, for ease of illustration, abrupt boundaries between the transitions 578 and the adjacent regions of the annular waveguide 570, actual transitions may constitute a gradual change from one waveguide region to the next.

A waveguide device, such as waveguide device 500, may be designed by using a commercial software package such as CST Microwave Studio. An initial model of the device may be generated with estimated dimensions for the waveguide, conductive fins and dielectric fins. The structure may then be analyzed, and the reflection coefficients and the relative phase shift for two orthogonal linearly polarized modes may be determined. The dimensions of the model may then be iterated manually or automatically to minimize reflection coefficients and to set the relative phase shift at or near a desired value, such as 90 degrees, across the operating frequency band.

To ensure that an undesired higher order mode does not resonate within the waveguide device 500, the Transverse Resonance Method may be employed. To employ this method, a model of the waveguide device 500 is split at a plane orthogonal to the axis and passing through the center of one of the high phase shift region 574*a*, 574*b*, or 574*c*. The undesired higher order mode may be excited at this split. The reflection phase for the higher order mode propagating to the left of the split may be calculated. Similarly, the reflection phase for the higher order mode propagating to the right of the split may be calculated. If the sum of the reflection phase for the higher order mode propagating to the left and the reflection phase for the higher order mode propagating to the right of the split are about zero or 360 degrees, the higher order mode may resonate within the feed network. If the sum of the reflection phases for the higher order modes propagating to the left and to the right of the split do not add up to zero or 360 degrees (+/−about 10 degrees) for all wavelengths within the operating frequency band, the higher order mode will not resonate within the waveguide device 500.

Figure 6:
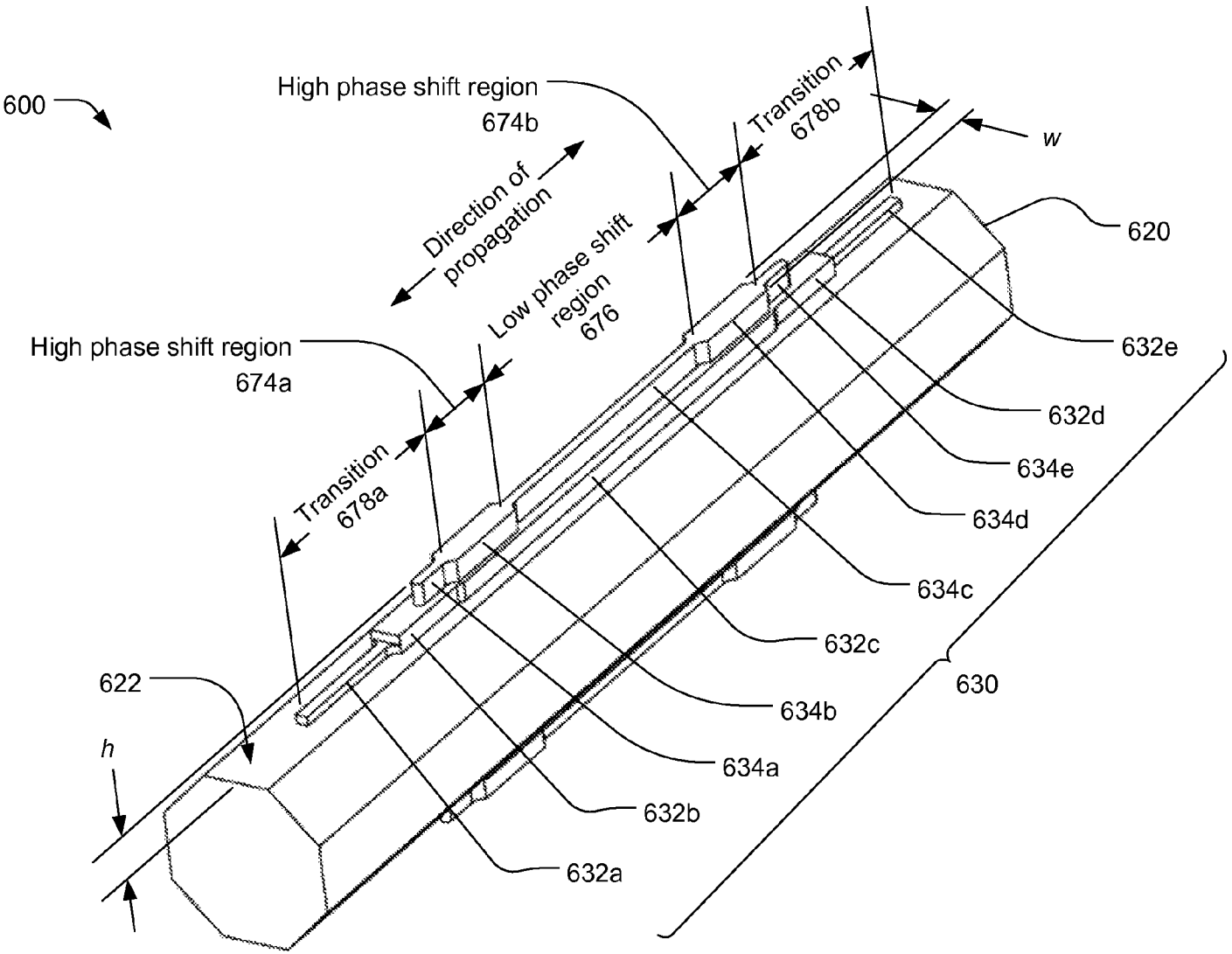
FIG. 6 is a perspective view of a stepped polarizer element.

FIG. 6 is a perspective view of an exemplary polarization converter 600 for use within an annular waveguide. The polarization converter 600 may include an inner conductor 620 having an outer surface 622. In use, the inner conductor 620 would typically be enclosed by an outer conductor (not shown) to form the annular waveguide. The outer surface 622 may have a cross-sectional shape of an octagon, as shown, a hexagon, or another regular polygon with an even number of sides. The outer surface 622 may have a circular cross section, similar to the outer surface 112 in FIG. 1. The cross section of the outer surface 622 may be a combination of circular segments and flat portions. The inner conductor 620 may be solid, as shown, or may be pierced by a cylindrical bore forming a circular waveguide coaxial with the annular waveguide. The presence or absence of the circular waveguide may not affect the operation of the polarization converter.

First and second diametrically-opposed fins 630 (only one of which is fully visible in FIG. 6) may extend from the inner conductor 620 into the annular waveguide. Each fin 630 may include a metal fin 632*a*, 632*b*, 632*c*, 632*d*, and 632*e* interlocked with a respective dielectric fin 634*a*, 634*b*, 634*c*, 634*d*, and 634*e*. The metal fins and dielectric fins may interlock using one or more of steps, tabs, slots, pins, notches, and holes as previously described. The metal fin may be divided into a plurality of sections 632*a*, 632*b*, 632*c*, 632*d*, 632*e*, each of which steps in height h and/or width w from adjacent metal fin sections. The dielectric fin may be divided into a plurality of sections 634*a*, 634*b*, 634*c*, 634*d*, 634*e*, each of which steps in at least width w from adjacent dielectric fin sections.

The fins 630 may function as loading structures to define a plurality of regions along a direction of propagation of electromagnetic waves within the annular waveguide. The fins 630 may define a first high phase shift region 674*a* and a second high phase shift region 674*b* separated by a low phase shift region 676. The fins 630 may define a first transition 678*a* and a second transition 678*b* adjacent to the high phase shift regions 674*a*, 674*b*, respectively. The transitions 678*a*, 678*b* may provide impedance matching between an annular waveguide without fins and the respective high phase shift regions 674*a*, 674*b*. The transitions 678*a*, 678*b* may introduce some phase shift and may be considered as additional low phase shift regions.

Specifically, the first transition 678*a* may correspond to the portion of the annular waveguide containing metal fin sections 632*a*, 632*b* and dielectric fin section 634*a*. The first high phase shift region 674*a* may correspond to dielectric fin section 634*b* in combination with metal fin section 632*c*. The low phase shift region 676 may correspond to dielectric fin section 634*c* in combination with metal fin section 632*c*. The second high phase shift region 674*b* may correspond to dielectric fin section 634*d* in combination with metal fin section 632*c*. In general, high phase shift regions may correspond to portions of the metal fins and/or dielectric fins having relatively larger height h and/or width w, and low phase shift regions may correspond to portions of the metal fins and/or dielectric fins having smaller height h and/or width w. The second transition 678*b* may correspond to the portion of the annular waveguide containing metal fin sections 632*d*, 632*e* and dielectric fin section 634*e*.

The fins 630 may be configured to provide, in combination, a desired phase shift, such as 90 degrees or 180 degrees, between two orthogonal electromagnetic waves propagating in the annular waveguide. The transition regions 678*a*, 678*b*, the high phase shift regions 674*a*, 674*b*, and the low phase shift region 676 may also be configured to act as a filter to suppress one or more undesired higher order modes from propagating or resonating in the annular waveguide. The low phase shift region 676 may be configured to allow propagation of orthogonal $HE_{11}$ modes over a predetermined operating bandwidth while suppressing, or cutting off, one or more higher order modes, such as an $HE_{21}$ mode, over the same operating bandwidth. For example, the fins 630 may be configured such that the $HE_{21}$ mode or some other higher order mode can propagate in the high phase shift regions 674*a*, 674*b* but is cut off in the low phase shift region 676. The low phase shift region 676 may be configured to allow propagation of only orthogonal $HE_{11}$ modes over the predetermined operating bandwidth.

Figure 7:
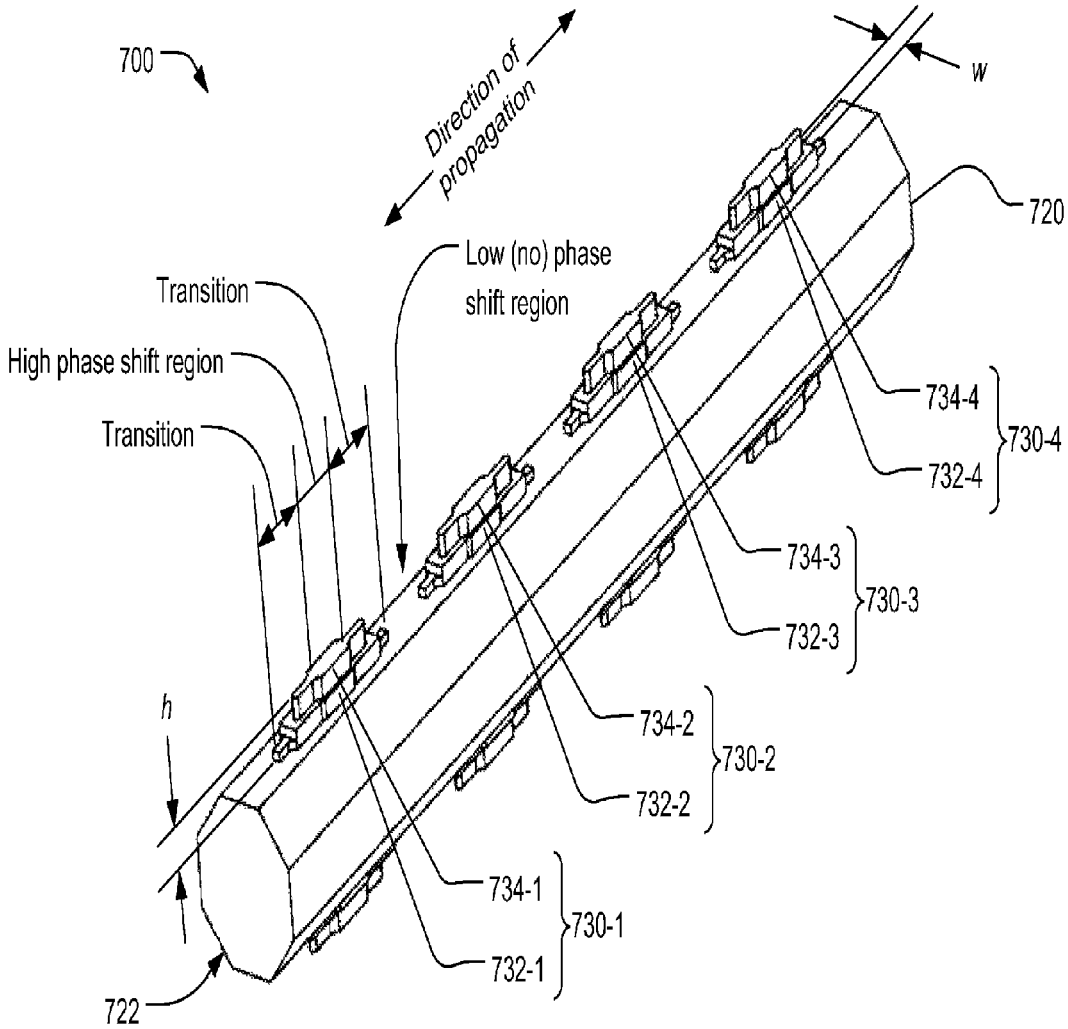
FIG. 7 is a perspective view of a stepped polarizer element.

FIG. 7 is a perspective view of another exemplary polarization converter 700 for use within an annular waveguide. The polarization converter 700 may include an inner conductor 720 having an outer surface 722. In use, the inner conductor 720 would typically be enclosed by an outer conductor (not shown) to form the annular waveguide. The outer surface 722 may have a cross-sectional shape of an octagon, as shown, a hexagon, or another regular polygon with an even number of sides. The outer surface 722 may have a circular cross section, similar to the outer surface 112 in FIG. 1. The cross section of the outer surface 722 may be a combination of circular and flat segments. The inner conductor 720 may be solid, as shown, or may be pierced by a cylindrical bore forming a circular waveguide coaxial with the annular waveguide. The presence or absence of the circular waveguide may not affect the operation of the polarization converter.

First and second diametrically opposed fins (only one of which is fully visible in FIG. 7) may extend from the outer surface 722. Each of the first and second fins may include a plurality of collinear finlets 730-1, 730-2, 730-3, 730-4. In this application, "finlet" is a coined term meaning a small fin that forms a portion of a greater fin. Each finlet may include a metal fin 732-1, 732-2, 732-3, 732-4 interlocked with a respective dielectric fin 734-1, 734-2, 734-3, 734-4. The metal fins and dielectric fins may interlock using one or more of steps, tabs, slots, pins, notches, and holes as previously described. In the example of FIG. 7, each of the first and second fins includes four finlets 730-1 to 730-4. A polarization converter may have more or fewer that four pairs of finlets.

Each metal fin 732-1 to 732-4 may be divided into a plurality of sections, each of which differs in height h and/or width w from adjacent metal fin sections. In the example of FIG. 4, each metal fin is divided into five sections. Each dielectric fin 734-1 to 734-4 may be divided into a plurality of sections, each of which differs in at least width w from adjacent dielectric fin sections. In the example of FIG. 7, each dielectric fin is divided into three sections. Fins may have more or fewer sections than shown in FIG. 7.

The finlets 730-1 to 730-4 may define a plurality of regions along a direction of propagation of electromagnetic waves within the annular waveguide. Each finlet 730-1 to 730-4 may define a high phase shift region sandwiched by two transitions. The transitions may provide impedance matching between the respective high phase shift regions and an annular waveguide without fins. The transitions may also contribute to the total phase shift provided by the polarization converter. The spaces between finlets 730-1 to 730-4 may define low phase shift regions. There may be no phase shift introduced over at least a portion of each low phase shift region.

The finlets 730-1 to 730-4 may be configured to provide, in combination, a desired phase shift, such as 90 degrees or 180 degrees, between two orthogonal electromagnetic waves propagating in the annular waveguide. The finlets 730-1 to 730-4 and the spaces between the finlets may also be configured to act as a filter to suppress one or more undesired higher order modes from propagating or resonating in the annular waveguide. The waveguide regions between the finlets may allow propagation of orthogonal $TE_{11}$ modes over a predetermined operating bandwidth while suppressing, or cutting off, one or more higher order modes over the same operating bandwidth. The waveguide regions between the fins may be configured to allow propagation of only orthogonal $TE_{11}$ modes over the predetermined operating bandwidth.

Figure 8:
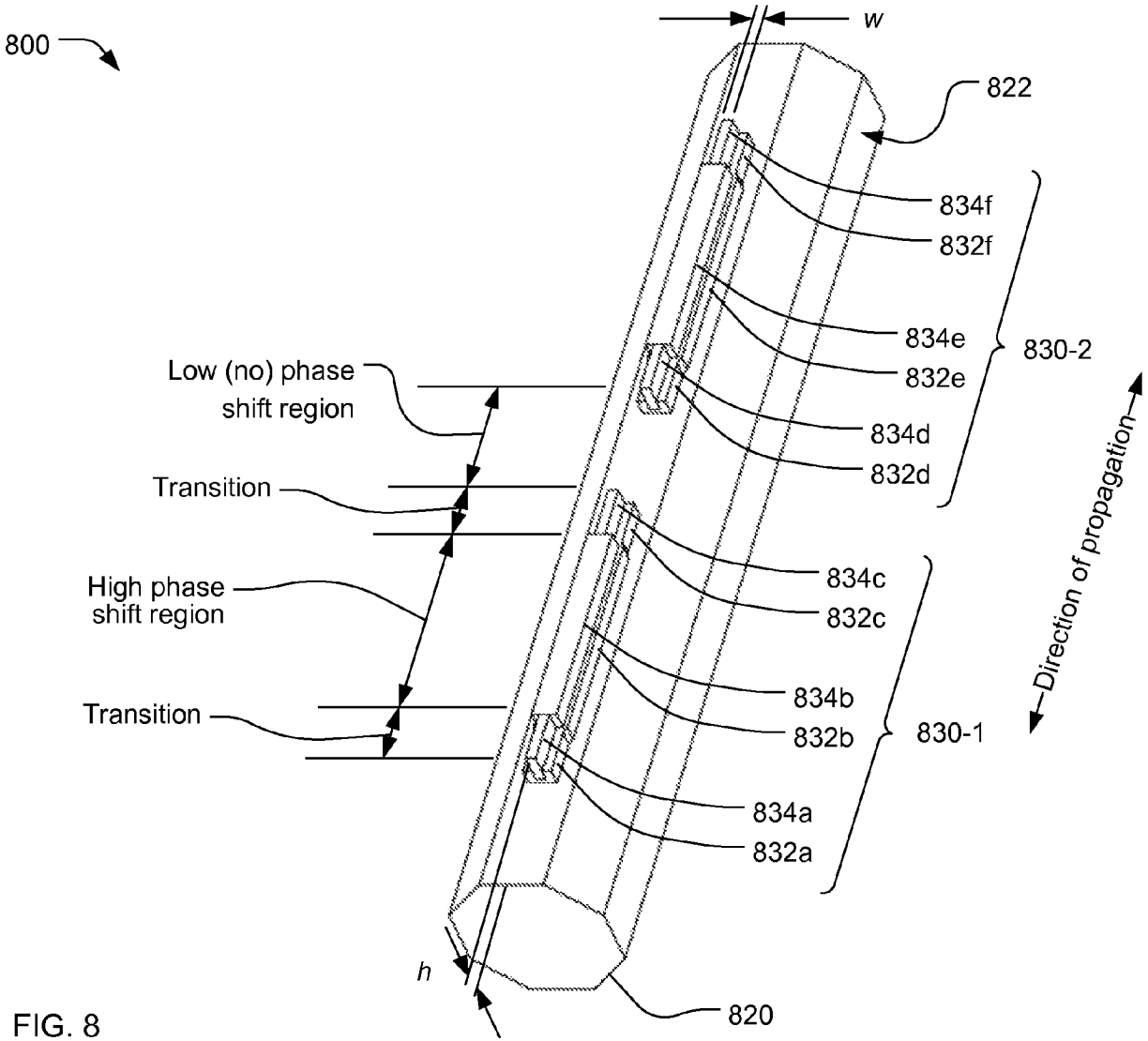
FIG. 8 is a perspective view of another stepped polarizer element.

FIG. 8 is a perspective view of another exemplary polarization converter 800 for use within an annular waveguide. The polarization converter 800 may include an inner conductor 820 having an outer surface 822. In use, the inner conductor 820 would typically be enclosed by an outer conductor (not shown) to form the annular waveguide. The outer surface 822 may have a cross-sectional shape of an octagon, as shown, a hexagon, or another regular polygon with an even number of sides. The outer surface 822 may have a circular cross section, similar to the outer surface 112 in FIG. 1. The cross section of the outer surface 822 may be a combination of circular and flat segments. The inner conductor 820 may be solid, as shown, or may be pierced by a cylindrical bore forming a circular waveguide coaxial with the annular waveguide. The presence or absence of the circular waveguide may not affect the operation of the polarization converter.

First and second diametrically opposed fins (only one of which is visible in FIG. 8) may extend from the outer surface 822. Each of the first and second fins may include a plurality of collinear finlets 830-1, 830-2. Each finlet may include a metal fin 832*a*/832*b*/832*c*, 832*d*/832*e*/832*f* interlocked with a respective dielectric fin 834*a*/834*b*/834*c*, 834*d*/834*e*/834*f*. The metal fins and dielectric fins may interlock using one or more of steps, tabs, slots, pins, notches, and holes as previously described. In the example of FIG. 8, each of the first and second fins includes two finlets 830-1, 830-2. A polarization converter may have more or fewer that two pairs of finlets.

Each metal fin may be divided into a plurality of sections 832*a*-832*f*, each of which differs in width w from adjacent metal fin sections. The height h of the metal fin section 832*a*-832*f* may be equal. In the example of FIG. 8, each metal fin is divided into three sections. Each dielectric fin may be divided into a plurality of sections 834*a*-834*f*, each of which differs in at least width w from adjacent dielectric fin sections. The height h of the dielectric fin section 834*a*-834*f* may be equal. In the example of FIG. 8, each dielectric fin is divided into three sections. Fins may have more or fewer sections than shown in FIG. 8.

The finlets 830-1, 830-2 may define a plurality of regions along a direction of propagation of electromagnetic waves within the annular waveguide. Each finlet 830-1, 830-2 may define a high phase shift region sandwiched by two transitions. The transitions may provide impedance matching between the respective high phase shift regions and an annular waveguide without fins. The transitions may contribute to the total phase shift introduced by the finlets. The spaces between finlets 830-1, 830-2 may define a low phase shift region. There may be no phase shift introduced over at least a portion of the low phase shift region.

The finlets 830-1, 830-2 may be configured to provide, in combination, a desired phase shift, such as 90 degrees or 180 degrees, between two orthogonal electromagnetic waves propagating in the annular waveguide. The finlets 830-1, 830-2 and the space between the finlets may also be configured to act as a filter to suppress one or more undesired higher order modes from propagating or resonating in the annular waveguide. The low phase shift region between the finlets 830-1, 830-2 may allow propagation of orthogonal $TE_{11}$ modes over a predetermined operating bandwidth while suppressing, or cutting off, one or more higher order modes over the same operating bandwidth. The low phase shift region between the finlets 830-1, 830-2 may be configured to allow propagation of only orthogonal $TE_{11}$ modes over the predetermined operating bandwidth.

Figure 9:
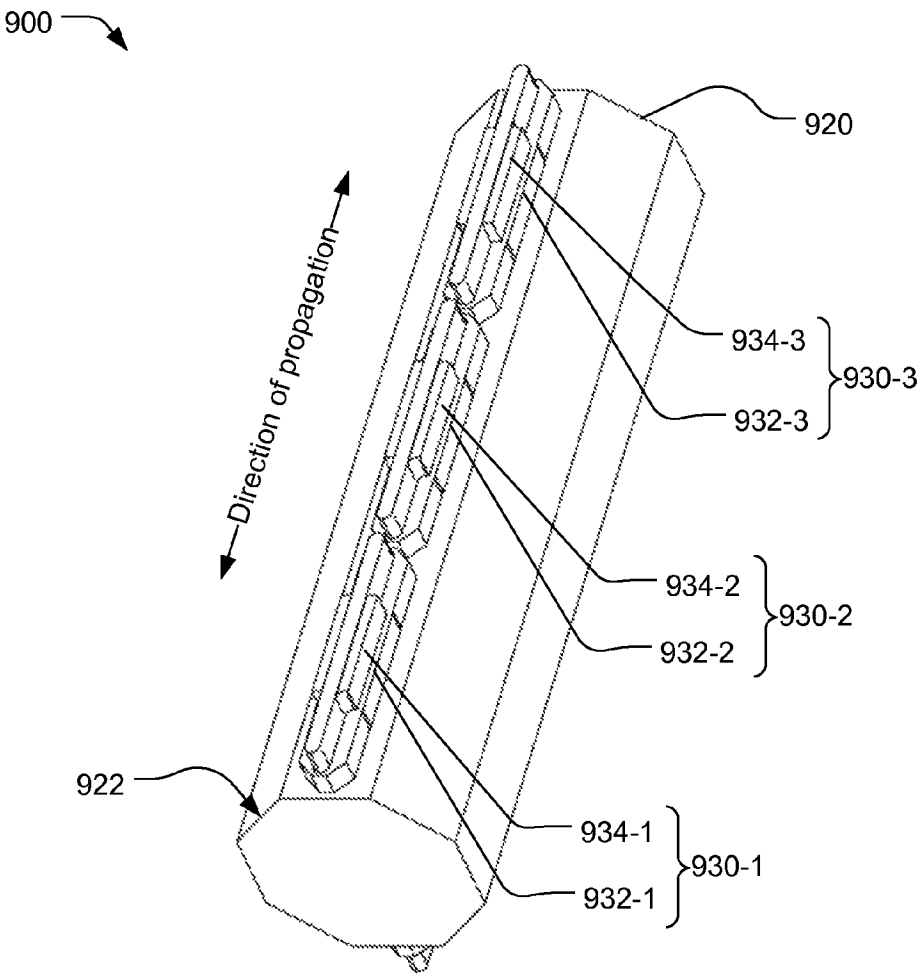
FIG. 9 is a perspective view of another stepped polarizer element.

FIG. 9 is a perspective view of another exemplary polarization converter 900 for use within an annular waveguide. The polarization converter 900 may include an inner conductor 920 having an outer surface 922. In use, the inner conductor 920 would typically be enclosed by an outer conductor (not shown) to form the annular waveguide. The outer surface 922 may have a cross-sectional shape of an octagon, as shown, a hexagon, or another regular polygon with an even number of sides. The outer surface 922 may have a circular cross section, similar to the outer surface 112 in FIG. 1. The cross section of the outer surface 922 may be a combination of circular and flat segments. The inner conductor 920 may be solid, as shown, or may be pierced by a cylindrical bore forming a circular waveguide coaxial with the annular waveguide. The presence or absence of the circular waveguide may not affect the operation of the polarization converter.

First and second diametrically opposed fins (only one of which is fully visible in FIG. 9) may extend from the outer surface 922. Each of the first and second fins may include a plurality of collinear finlets 930-1, 930-2, 930-3. Each finlet may include a metal fin 932-1, 932-2, 932-3, interlocked with a respective dielectric fin 934-1, 934-2, 934-3. The metal fins and dielectric fins may interlock using one or more of steps, tabs, slots, pins, notches, and holes as previously described.

Each metal fin 932-1 to 932-3 may be divided into a plurality of sections, each of which differs in height and/or width from adjacent metal fin sections. In the example of FIG. 9, each metal fin is divided into three sections. Each dielectric fin 934-1 to 934-3 may be divided into a plurality of sections, each of which differs in at least width from adjacent dielectric fin sections. In the example of FIG. 9, each dielectric fin is divided into three sections.

The finlets 930-1 to 930-3 may be configured to provide, in combination, a phase shift of approximately 90 degrees between two orthogonal electromagnetic waves propagating in the annular waveguide. The finlets 930-1 to 930-3 and the spaces between the finlets may also be configured to act as a filter to suppress one or more undesired higher order modes from propagating or resonating in the annular waveguide.

Figure 10:
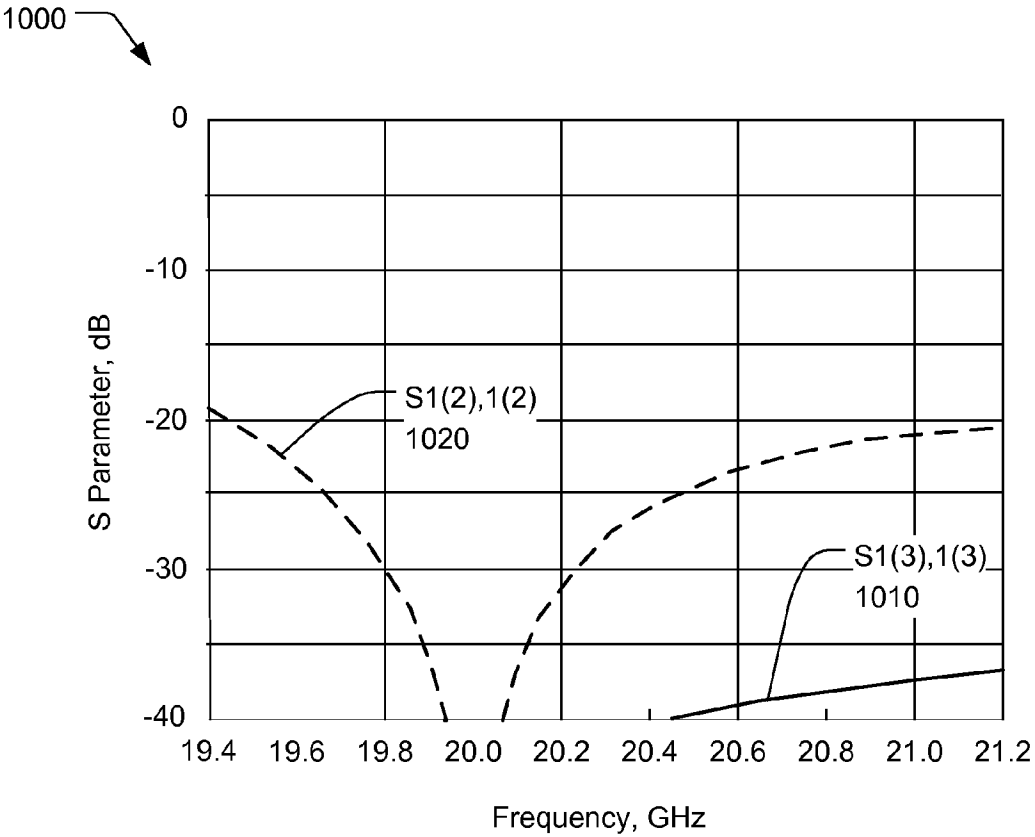
FIG. 10 is a graph showing the simulated performance of a linear polarization to circular polarization converter using the stepped polarizer element of FIG. 9.

FIG. 10 is a graph 1000 illustrating the simulated performance of a linear to circular polarization converter including a stepped polarizer element similar to the polarization converter 900 within an annular waveguide. The performance of a waveguide device such as a linear to circular polarization converter is commonly expressed in terms of scattering parameters or S parameters. For example, S1,1 is a parameter indicating the portion of a signal introduced at a first port that is reflected back to the first port, which is to say the return loss at the first port. S parameters are commonly expressed in decibels or dB. The performance of the linear to circular polarization converter was simulated using finite integral time domain analysis. The time-domain simulation results were Fourier transformed into frequency-domain S-parameter data as shown in FIG. 10. The solid line 1010 plots the return loss S1(3), 1(3) introduced by the linear to circular polarization converter in a first linearly polarized $TE_{11}$ mode. The dashed line 1020 plots the return loss S1(2), 1(2) introduced by the linear to circular polarization converter in a second linearly polarized $TE_{11}$ mode orthogonal to the first $TE_{11}$ mode. The return loss is less than 19 dB over a frequency band from 19.4 GHz (Gigahertz) to 21.2 GHz. The stepped polarizer element provides a phase shift of approximately 90 degrees over the frequency band without any resonance of higher order modes.

CLOSING COMMENTS

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

The invention claimed is:

1. A polarization converter, comprising:

an annular waveguide comprising an inner conductor having an outer surface and an outer conductor having an inner surface coaxial with the outer surface of the inner conductor; and a plurality of loading structures within the annular waveguide, the plurality of loading structures configured to form a plurality of regions within the annular waveguide including an alternating sequence of high phase shift regions and low phase shift regions along a direction of propagation of an electromagnetic wave, the electromagnetic wave having a frequency within a predetermined operating frequency band, wherein the plurality of loading structures, in combination, are configured to introduce a predetermined relative phase shift between orthogonally polarized first and second components of the electromagnetic wave, and the plurality of loading structures are further configured to cut off propagation of one or more higher order modes in the low phase shift regions of the annular waveguide over the operating frequency band.

2. The polarization converter of claim 1, wherein the plurality of loading structures are configured to collectively introduce a relative phase shift of essentially 90 degrees between the orthogonally polarized first and second components of the electromagnetic wave.

3. The polarization converter of claim 1, wherein the outer surface of the inner conductor has one of a generally circular cross section and a cross section in the shape of a regular polygon having an even number of sides, the number of sides equal to six or more the inner surface of the outer conductor has a generally circular cross section coaxial with the outer surface of the inner conductor.

4. The polarization converter of claim 1, wherein the plurality of loading structures are configured to allow propagation of orthogonal $TE_{11}$ or $HE_{11}$ modes in the low phase shift regions of the annular waveguide.

5. The polarization converter of claim 1, wherein the plurality of loading structures comprises diametrically opposed first and second fins extending from the outer surface of the inner conductor.

6. The polarization converter of claim 5, wherein each of the first and second fins includes a conductive fin and a dielectric fin.

7. The polarization converter of claim 6, wherein a width of each dielectric fin changes between a greater width and a lesser width in one or more steps along the direction of propagation.

8. The polarization converter of claim 6, wherein each conductive fin is interlocked with the respective dielectric fin.

9. A polarization converter, comprising:

an annular waveguide comprising an inner conductor having an outer surface and an outer conductor having an inner surface coaxial with the outer surface of the inner conductor; and diametrically opposed first and second fins extending from the outer surface of the inner conductor, each of the first and second fins comprising a plurality of collinear finlets separated by spaces, wherein the first and second fins are configured to form a plurality of regions within the annular waveguide including an alternating sequence of high phase shift regions and low phase shift regions along a direction of propagation of an electromagnetic wave, the electromagnetic wave having a frequency within a predetermined operating frequency band, the first and second fins, in combination, are configured to introduce a predetermined relative phase shift between orthogonally polarized first and second components of the electromagnetic wave, and the first and second fins are further configured to suppress propagation of one or more higher order modes in the annular waveguide over the operating frequency band.

10. The polarization converter of claim 9, wherein the outer surface of the inner conductor has one of a generally circular cross section and a cross section in the shape of a regular polygon having an even number of sides, the number of sides equal to six or more the inner surface of the outer conductor has a generally circular cross section coaxial with the outer surface of the inner conductor.

11. The polarization converter of claim 9, wherein each finlet forms a high phase shift region in the annular waveguide.

12. The polarization converter of claim 9, wherein each finlet forms transitions adjacent to the high phase shift region in the annular waveguide.

13. The polarization converter of claim 9, where each finlet includes a conductive portion and a dielectric portion.

14. The polarization converter of claim 13, wherein each conductive portion is interlocked with the respective dielectric portion.

15. The polarization converter of claim 9, wherein the first and second fins are configured to collectively introduce a relative phase shift of essentially 90 degrees between the first and second components of the electromagnetic wave.

* * * * *